US011735091B2

(12) United States Patent
Zhao et al.

(10) Patent No.: US 11,735,091 B2
(45) Date of Patent: Aug. 22, 2023

(54) COMPENSATION FOR GRAY-SCALE OF DISPLAY DEVICE

(71) Applicant: TCL China Star Optoelectronics Technology Co., Ltd., Guangdong (CN)

(72) Inventors: Yizhuo Zhao, Guangdong (CN); Yuhua Chang, Guangdong (CN); Bin Zhao, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 29 days.

(21) Appl. No.: 17/435,043

(22) PCT Filed: Dec. 28, 2020

(86) PCT No.: PCT/CN2020/140355

§ 371 (c)(1),
(2) Date: Aug. 31, 2021

(87) PCT Pub. No.: WO2022/068111

PCT Pub. Date: Apr. 7, 2022

(65) Prior Publication Data

US 2022/0327984 A1 Oct. 13, 2022

(30) Foreign Application Priority Data

Sep. 30, 2020 (CN) ..... 202011058737.0

(51) Int. Cl.
*G09G 3/20* (2006.01)

(52) U.S. Cl.
CPC ..... *G09G 3/2007* (2013.01); *G09G 2310/08* (2013.01); *G09G 2320/0233* (2013.01); *G09G 2320/0247* (2013.01)

(58) Field of Classification Search
None
See application file for complete search history.

(56) References Cited

U.S. PATENT DOCUMENTS

| | | | | |
|---|---|---|---|---|
| 2018/0144681 | A1* | 5/2018 | Xiang | G09G 3/3233 |
| 2021/0027686 | A1* | 1/2021 | Roh | G09G 3/20 |
| 2021/0398508 | A1* | 12/2021 | Lee | G09G 3/20 |

FOREIGN PATENT DOCUMENTS

| | | |
|---|---|---|
| CN | 105094272 | 11/2015 |
| CN | 107039013 | 8/2017 |
| CN | 108109583 | 6/2018 |
| CN | 108335677 | 7/2018 |
| CN | 108806620 | 11/2018 |

(Continued)

*Primary Examiner* — Benjamin C Lee
*Assistant Examiner* — Emily J Frank

(57) ABSTRACT

The driving method provided by the present application includes: detecting a refresh frequency of a display device based on a plurality of predicted frames to obtain a change rule of the refresh frequency; obtaining a current refresh frequency of the display device and a corresponding frame number information; predicting an expected timing when the display device switches the refresh frequency next time and an expected frequency value after switching according to the change rule, the current refresh frequency, and the corresponding frame number information; and performing a gray-scale compensation on the display device according to the expected frequency value and the expected timing.

5 Claims, 4 Drawing Sheets

(56) References Cited

FOREIGN PATENT DOCUMENTS

| | | |
|---|---|---|
| CN | 109256098 | 1/2019 |
| CN | 109587468 | 4/2019 |
| CN | 111105758 | 5/2020 |
| CN | 111312191 | 6/2020 |
| CN | 111540331 | 8/2020 |
| CN | 1116403 90 | 9/2020 |
| WO | WO 2015/172725 | 11/2015 |

* cited by examiner

COMPENSATION FOR GRAY-SCALE OF DISPLAY DEVICE

RELATED APPLICATIONS

This application is a National Phase of PCT Patent Application No. PCT/CN2020/140355 having International filing date of Dec. 28, 2020, which claims the benefit of priority under of Chinese Patent Application No. 202011058737.0 filed on Sep. 30, 2020. The contents of the above applications are all incorporated by reference as if fully set forth herein in their entirety.

FIELD AND BACKGROUND OF THE INVENTION

The present disclosure relates to the field of display technology, in particular to a driving method of a display device and a display device.

Generally, a refresh frequency of a display device is often fixed at a certain frequency when the display device is working. For example, a most common refresh frequency is 60 Hz. However, under certain specific conditions, it is often necessary for the display device to display at a higher refresh frequency. Free-Sync technology allows a graphics card and an accelerated processor to directly and dynamically control the refresh frequency of the display device connected.

For a display device equipped with the Free-Sync technology, a charging time for each frame of a highest refresh frequency and a charging time for each frame of a lowest refresh frequency are the same, and one difference is that blank times between the two kinds of frames are different. Since a frame duration time corresponding to a low refresh frequency is longer, a blank time thereof will be longer compared to a blank time corresponding to a high refresh frequency. However, too long of the blank time will deepen an impact of leakage on the display panel, and ultimately reduce overall brightness of the display panel. If the display device is made to switch back and forth between the high and low refresh frequencies in a short time period according to a certain rule, a difference in brightness between different refresh frequencies will cause serious flicking on a display screen.

SUMMARY OF THE INVENTION

A purpose of the present disclosure is to provide a driving method of a display device and a display device, which can prevent flickering of a screen when switching a refresh frequency.

In a first aspect, the present disclosure provides a driving method of a display device, comprising following steps:

obtaining a plurality of predicted frames, and detecting a refresh frequency of the display device based on the plurality of predicted frames to obtain a change rule of the refresh frequency;

obtaining a current refresh frequency of the display device and a corresponding frame number information when the display device displays a target display frame;

predicting an expected timing when the display device switches the refresh frequency next time and an expected frequency value after switching according to the change rule, the current refresh frequency, and the corresponding frame number information; and performing a gray-scale compensation on the display device according to the expected frequency value and the expected timing, wherein the step of predicting the expected timing when the display device switches the refresh frequency next time and the expected frequency value after switching according to the change rule, the current refresh frequency, and the corresponding frame number information comprises:

obtaining the expected frequency value after switching according to the change rule and the current refresh frequency;

obtaining remaining frame number information of the current refresh frequency according to the change rule and the corresponding frame number information; and obtaining the expected timing for a next refresh frequency switching according to the remaining frame number information, wherein the step of performing the gray-scale compensation on the display device according to the expected frequency value and the expected timing comprises:

querying a gray-scale compensation table according to the expected frequency value to obtain a corresponding gray-scale compensation value; and performing the gray-scale compensation on the display device at the expected timing according to the gray-scale compensation value.

In the driving method provided by the present disclosure, the step of obtaining the plurality of predicted frames, and detecting the refresh frequency of the display device based on the plurality of predicted frames to obtain the change rule of the refresh frequency comprises:

obtaining the plurality of predicted frames, and performing a real-time detection on the refresh frequency when the plurality of predicted frames are played on the display device to obtain a plurality of frequency values of the refresh frequency; and detecting a number of continuous frames of each of the frequency values through a frequency prediction signal to obtain the number of continuous frames corresponding to each of the frequency values.

In the driving method provided by the present disclosure, the step of obtaining the plurality of predicted frames, and performing the real-time detection on the refresh frequency when the plurality of predicted frames are played on the display device to obtain the plurality of frequency values of the refresh frequency comprises:

obtaining the plurality of predicted frames and playing on the display device; and performing the real-time detection of the refresh frequency of the display device to obtain the plurality of frequency values of the refresh frequency after playback continues for a first preset time period.

In the driving method provided by the present disclosure, the step of detecting the number of continuous frames of each of the frequency values through the frequency prediction signal to obtain the number of continuous frames corresponding to each of the frequency values comprises:

performing a plurality times of detection on the number of continuous frames of each of the frequency values through the frequency prediction signal to obtain a plurality of numbers of continuous frames corresponding to each of the frequency values; and calculating an actual number of continuous frames corresponding to each of the frequency values according to the plurality of numbers of continuous frames.

In the driving method provided by the present disclosure, the step of performing the gray-scale compensation on the display device at the expected timing according to the gray-scale compensation value comprises:

querying the gray-scale compensation table according to the expected frequency value to obtain the corresponding gray-scale compensation value;

obtaining a prediction of the expected timing when the next refresh frequency switching occurs;

obtaining a target gray-scale compensation value according to the prediction and the gray-scale compensation value; and performing the gray-scale compensation on the display device according to the target gray-scale compensation value when the refresh frequency is switched.

In the driving method provided by the present disclosure, the step of obtaining the target gray-scale compensation value according to the prediction and the gray-scale compensation value comprises:

if the expected timing is earlier than an actual refresh frequency switching timing, and a frequency value before switching is less than the expected frequency value after switching, the gray-scale compensation value is optimized according to a first compensation coefficient X1 to obtain the target gray-scale compensation value, and X1 is greater than 1; and if the expected timing is later than the actual refresh frequency switching timing, and the frequency value before switching is less than the frequency value after switching, the gray-scale compensation value is optimized according to a second compensation coefficient X2 to obtain the target gray-scale compensation value, and X2 is less than 1 and greater than 0.

In the driving method provided by the present disclosure, the step of obtaining the target gray-scale compensation value according to the prediction and the gray-scale compensation value further comprises:

if the expected timing is equal to the actual refresh frequency switching timing, the gray-scale compensation value is used as the target gray-scale compensation value.

In a second aspect, the present disclosure provides a driving method of a display device, which comprises following steps:

obtaining a plurality of predicted frames, and detecting a refresh frequency of the display device based on the plurality of predicted frames to obtain a change rule of the refresh frequency;

obtaining a current refresh frequency of the display device and a corresponding frame number information when the display device displays a target display frame;

predicting an expected timing when the display device switches the refresh frequency next time and an expected frequency value after switching according to the change rule, the current refresh frequency, and the corresponding frame number information; and performing a gray-scale compensation on the display device according to the expected frequency value and the expected timing.

In the driving method provided by the present disclosure, the step of obtaining the plurality of predicted frames, and detecting the refresh frequency of the display device based on the plurality of predicted frames to obtain the change rule of the refresh frequency comprises:

obtaining the plurality of predicted frames, and performing a real-time detection on the refresh frequency when the plurality of predicted frames are played on the display device to obtain a plurality of frequency values of the refresh frequency; and detecting a number of continuous frames of each of the frequency values through a frequency prediction signal to obtain the number of continuous frames corresponding to each of the frequency values.

In the driving method provided by the present disclosure, the step of obtaining the plurality of predicted frames, and detecting the refresh frequency of the display device based on the plurality of predicted frames to obtain the change rule of the refresh frequency comprises:

obtaining the plurality of predicted frames, and performing a real-time detection on the refresh frequency when the plurality of predicted frames are played on the display device to obtain a plurality of frequency values of the refresh frequency; and detecting a number of continuous frames of each of the frequency values through a frequency prediction signal to obtain the number of continuous frames corresponding to each of the frequency values.

In the driving method provided by the present disclosure, the step of obtaining the plurality of predicted frames, and performing the real-time detection on the refresh frequency when the plurality of predicted frames are played on the display device to obtain the plurality of frequency values of the refresh frequency comprises:

obtaining the plurality of predicted frames and playing on the display device; and performing the real-time detection of the refresh frequency of the display device to obtain the plurality of frequency values of the refresh frequency after playback continues for a first preset time period.

In the driving method provided by the present disclosure, the step of detecting the number of continuous frames of each of the frequency values through the frequency prediction signal to obtain the number of continuous frames corresponding to each of the frequency values comprises:

performing a plurality times of detection on the number of continuous frames of each of the frequency values through the frequency prediction signal to obtain a plurality of numbers of continuous frames corresponding to each of the frequency values; and In the driving method provided by the present disclosure, the step of predicting the expected timing when the display device switches the refresh frequency next time and the expected frequency value after switching according to the change rule, the current refresh frequency, and the corresponding frame number information comprises:

obtaining the expected frequency value after switching according to the change rule and the current refresh frequency;

obtaining remaining frame number information of the current refresh frequency according to the change rule and the corresponding frame number information; and obtaining the expected timing for a next refresh frequency switching according to the remaining frame number information.

In the driving method provided by the present disclosure, the step of performing the gray-scale compensation on the display device according to the expected frequency value and the expected timing comprises:

querying a gray-scale compensation table according to the expected frequency value to obtain a corresponding gray-scale compensation value; and performing the gray-scale compensation on the display device at the expected timing according to the gray-scale compensation value.

In the driving method provided by the present disclosure, the step of performing the gray-scale compensation on the display device at the expected timing according to the gray-scale compensation value comprises:

querying a gray-scale compensation table according to the expected frequency value to obtain a corresponding gray-scale compensation value;

obtaining a prediction of the expected timing when a next refresh frequency switching occurs;

obtaining a target gray-scale compensation value according to the prediction and the gray-scale compensation value; and performing the gray-scale compensation on the display device according to the target gray-scale compensation value when the refresh frequency is switched.

In the driving method provided by the present disclosure, the step of obtaining the target gray-scale compensation value according to the prediction and the gray-scale compensation value comprises:

if the expected timing is earlier than an actual refresh frequency switching timing, and a frequency value before switching is less than the expected frequency value after switching, the gray-scale compensation value is optimized according to a first compensation coefficient X1 to obtain the target gray-scale compensation value, and X1 is greater than 1; and if the expected timing is later than the actual refresh frequency switching timing, and the frequency value before switching is less than the frequency value after switching, the gray-scale compensation value is optimized according to a second compensation coefficient X2 to obtain the target gray-scale compensation value, and X2 is less than 1 and greater than 0.

In the driving method provided by the present disclosure, the step of obtaining the target gray-scale compensation value according to the prediction and the gray-scale compensation value further comprises:

if the expected timing is equal to the actual refresh frequency switching timing, the gray-scale compensation value is used as the target gray-scale compensation value.

In a third aspect, the present disclosure provides a display device, which comprises:

a first detection module is configured to obtain a plurality of predicted frames, and detect a refresh frequency of the display device based on the plurality of predicted frames to obtain a change rule of the refresh frequency;

an acquisition module configured to obtain a current refresh frequency of the display device and a corresponding frame number information when the display device displays a target display frame;

a prediction module configured to predict an expected timing when the display device switches the refresh frequency next time and an expected frequency value after switching according to the change rule, the current refresh frequency, and the corresponding frame number information; and a compensation module configured to perform a gray-scale compensation on the display device according to the expected frequency value and the expected timing.

In the display device provided by the present disclosure, the first detection module specifically comprises:

obtaining the plurality of predicted frames, and performing a real-time detection on the refresh frequency when the plurality of predicted frames are played on the display device to obtain a plurality of frequency values of the refresh frequency; and detecting a number of continuous frames of each of the frequency values through a frequency prediction signal to obtain the number of continuous frames corresponding to each of the frequency values.

In the display device provided by the present disclosure, the prediction module specifically comprises:

obtaining the expected frequency value after switching according to the change rule and the current refresh frequency;

obtaining remaining frame number information of the current refresh frequency according to the change rule and the corresponding frame number information; and obtaining the expected timing for a next refresh frequency switching according to the remaining frame number information.

In the display device provided in the present disclosure, the compensation module specifically comprises:

querying a gray-scale compensation table according to the expected frequency value to obtain a corresponding gray-scale compensation value; and performing the gray-scale compensation on the display device at the expected timing according to the gray-scale compensation value.

In the driving method of the display device and the display device provided by the present disclosure, the plurality of predicted frames are inputted, and the refresh frequency of the display device are detected based on the plurality of predicted frames to obtain the change rule of the refresh frequency; when the display device displays the target display frame, the current refresh frequency of the display device and the corresponding frame number information are obtained; the expected timing when the display device switches the refresh frequency next time and the expected frequency value after switching are predicted according to the change rule, the current refresh frequency, and the corresponding frame number information; and the gray-scale compensation is performed on the display device according to the expected frequency value and the expected timing. Therefore, an advance prediction of frequency switching is realized, and then an advance calculation of the gray-scale compensation value is realized, which can prevent flicking caused when the refresh frequency changes.

BRIEF DESCRIPTION OF THE SEVERAL VIEWS OF THE DRAWINGS

In order to more clearly explain the technical solutions in the embodiments of the present disclosure, the following will briefly introduce the drawings required in the description of the embodiments. Obviously, the drawings in the following description are only some embodiments of the present disclosure. For those skilled in the art, without paying any creative work, other drawings can be obtained based on these drawings.

DESCRIPTION OF SPECIFIC EMBODIMENTS OF THE INVENTION

Technical solutions in the embodiments of the present disclosure will be clearly and completely described below in conjunction with drawings in the embodiments of the present disclosure. Obviously, the described embodiments are only a part of embodiments of the present disclosure, rather than all the embodiments. Based on the embodiments in the present disclosure, all other embodiments obtained by those skilled in the art without creative work fall within the protection scope of the present disclosure.

Figure 1:
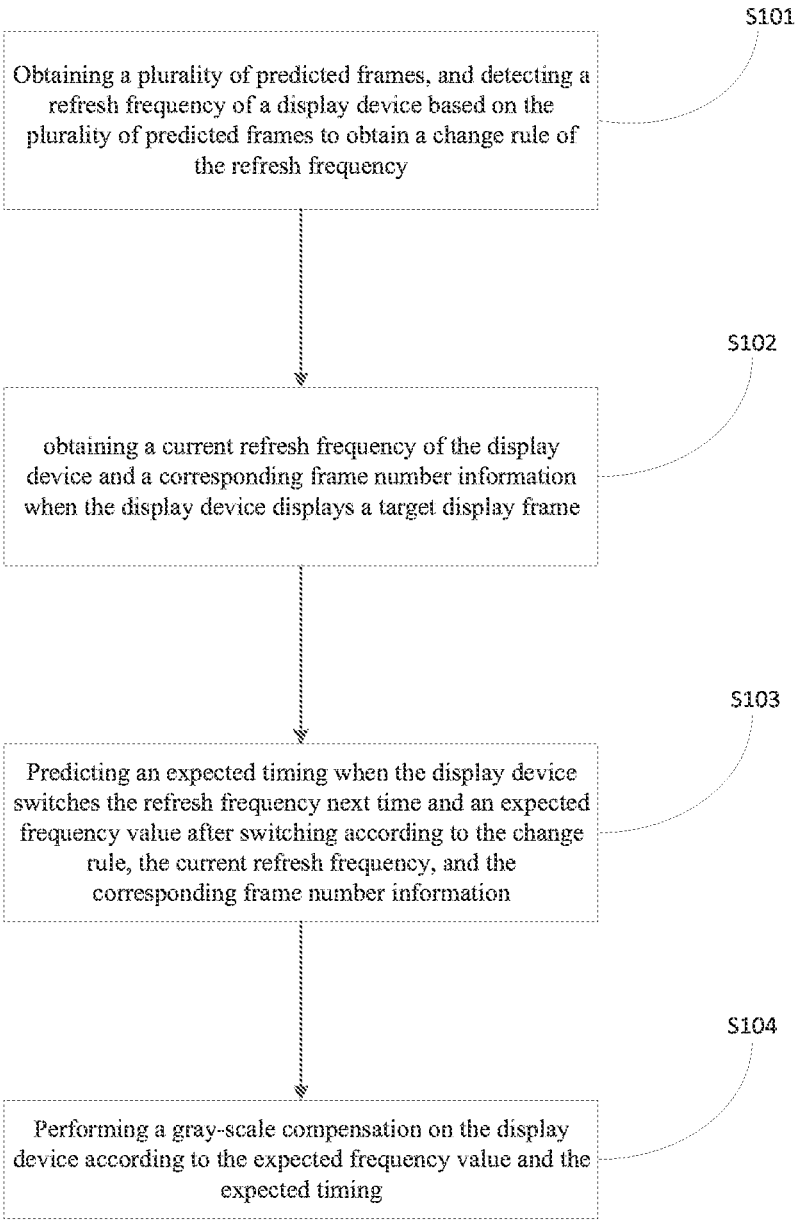
FIG. 1 is a schematic flowchart of a driving method of a display device provided by an embodiment of the present disclosure.

Please refer to FIG. 1, which is a schematic flowchart of a driving method of a display device provided by an embodiment of the present disclosure. The driving method is used in the display device, and the display device may be an organic light-emitting display or a liquid crystal display, apparently, it may also be other common display devices. Wherein, the driving method comprises following steps:

S101, obtaining a plurality of predicted frames, and detecting a refresh frequency of the display device based on the plurality of predicted frames to obtain a change rule of the refresh frequency.

S102, obtaining a current refresh frequency of the display device and a corresponding frame number information when the display device displays a target display frame.

S103, predicting an expected timing when the display device switches the refresh frequency next time and an expected frequency value after switching according to the change rule, the current refresh frequency, and the corresponding frame number information.

S104, performing a gray-scale compensation on the display device according to the expected frequency value and the expected timing.

In the driving method of the display device provided by the embodiment of the present disclosure, the plurality of predicted frames are inputted, and the refresh frequency of the display device are detected based on the plurality of predicted frames to obtain the change rule of the refresh frequency; when the display device displays the target display frame, the current refresh frequency of the display device and the corresponding frame number information are obtained; the expected timing when the display device switches the refresh frequency next time and the expected frequency value after switching are predicted according to the change rule, the current refresh frequency, and the corresponding frame number information; and the gray-scale compensation is performed on the display device according to the expected frequency value and the expected timing. Therefore, an advance prediction of frequency switching is realized, and then an advance calculation of a gray-scale compensation value is realized, which can prevent flicking caused when the refresh frequency changes.

Figure 2A:
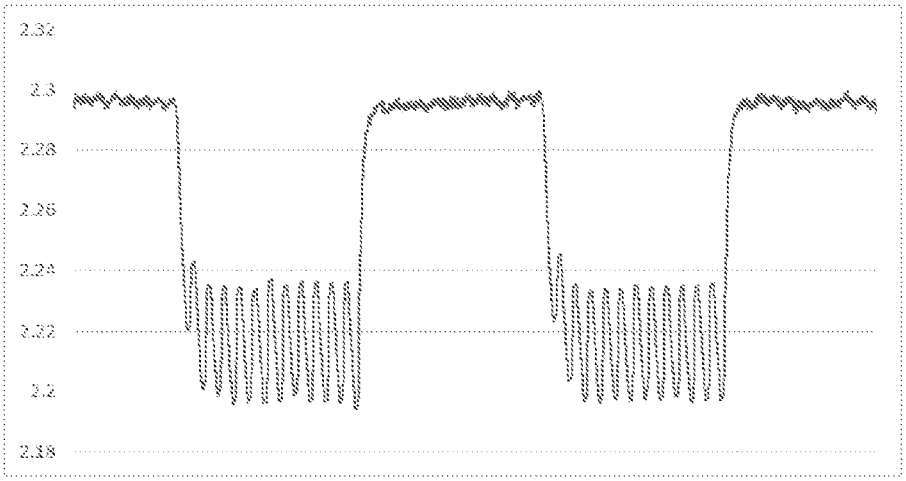
FIGS. 2*a*, 2*b* and 2*c* are schematic diagrams of comparison of brightness waveforms of the driving method of the display device provided by the embodiment of the present disclosure.
Figure 2B:
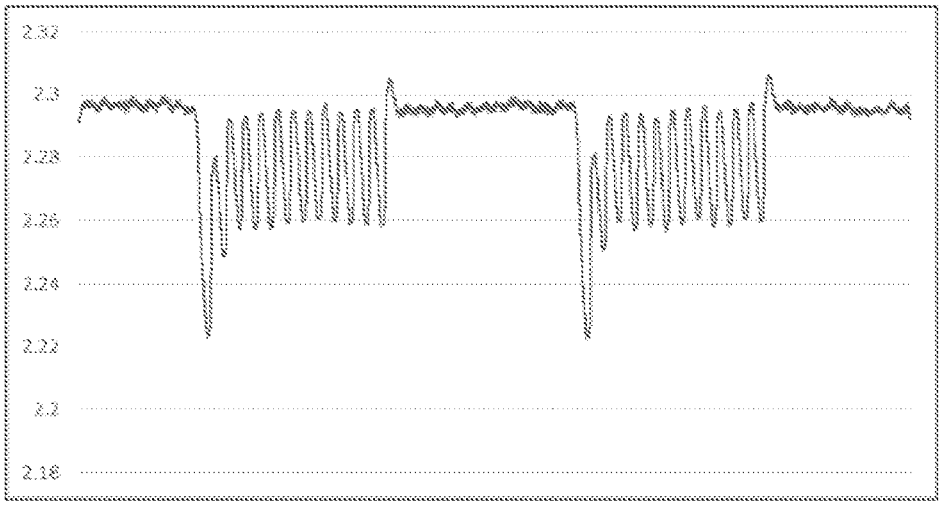
Figure 2C:
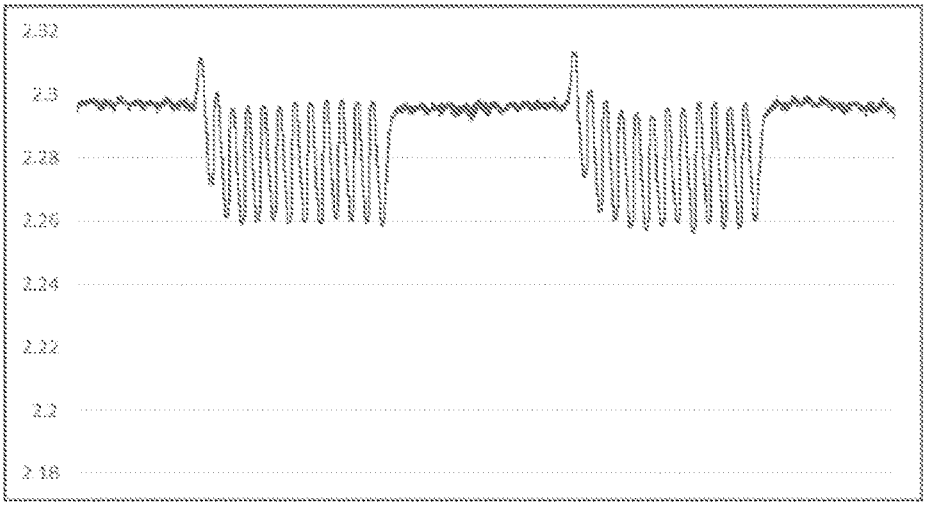

For example, please refer to FIGS. 2*a*-2*c*. FIGS. 2*a*-2*c* are schematic diagrams of comparison of brightness waveforms of the driving method of the display device provided by the embodiment of the present disclosure. As shown in FIGS. 2*a*-2*c*, FIG. 2*a* shows a brightness waveform when switching between different frequencies. It can be seen that frames are densely arranged in high-frequency periods and overall brightness is higher; and frames are sparsely arranged in low-frequency periods, and the overall brightness is lower. Moreover, leakage of electricity will cause great fluctuations in brightness, and a screen of the display device flickers seriously at this time. Therefore, a gray-scale compensation table can be set to increase gray-scales in the low-frequency periods to compensate for brightness difference between low-frequency regions and high-frequency regions. At present, a frequency adjustment range of mainstream display devices is from 48 Hz to 240 Hz, and some key frequencies are selected therefrom to set compensation binding points, and remaining frequencies are obtained by interpolation from the gray-scale compensation table.

In actual work of the display device, a frame frequency can be detected after a current frame transmission is completed. If no other processing is done, no new gray-scale compensation will be applied to a first frame after switching from a high-frequency to a low-frequency, and a low-frequency gray-scale compensation will be applied to a first frame after switching from the low-frequency to the high-frequency. In this way, as shown in FIG. 2*b*, brightness spikes will appear when switching between different frequencies due to inability to detect frequencies in advance. If a frequency switching signal can be obtained in advance, it can smoothly provide a suitable gray-scale for the first frame after the frequency switching, as shown in FIG. 2*c*. That is, the driving method provided by the embodiment of the present disclosure can realize the advance prediction of the frequency switching, thereby realizing advance calculation of the gray-scale compensation value, which can prevent flicking caused when the refresh frequency changes.

Specifically, in the step S101, the plurality of predicted frames, that is, images used to detect the change rule of the refresh frequency of the display device, are pre-stored in a memory of the display device. When it is detected that the display device is powered on, the plurality of predicted frames in the memory are automatically extracted and played, so as to realize detection of the change rule of a screen refresh chip.

Wherein, the change rule of the refresh frequency comprises all frequency values of the refresh frequency of the display device and a sequence thereof, and a number of continuous frames or a duration time of each frequency value. For example, the frequency values are sorted by time as a1, a2, a3, a4, and a5. When it is detected that the frequency value is a2, the frequency value after next switching is a3.

Wherein, in some embodiments, the step S101 may specifically comprise following sub-steps:

S1011, obtaining the plurality of predicted frames, and performing a real-time detection on the refresh frequency when the plurality of predicted frames are played on the display device, so as to obtain a plurality of frequency values of the refresh frequency; and S1012, detecting the number of continuous frames of each frequency value through a frequency prediction signal to obtain the number of continuous frames corresponding to each frequency value.

Wherein, the step S1011 may specifically comprise: obtaining the plurality of predicted frames and playing on the display device; and after playback continues for a first preset time period, performing the real-time detection of the refresh frequency of the display device to obtain the plurality of frequency values of the refresh frequency.

Wherein, when the refresh frequency starts to change, generally speaking, the refresh frequency starts to change after a certain time period after starting to play the plurality of predicted frames. After the first preset time period, the refresh frequency gradually changes from irregular changes to regular changes and tends to be stable. Therefore, counting starts at this time to detect a number of changed frequency values and corresponding frequency values. After two times of switching are completed at different frequency values, determination can be made, and the number of the changed frequency values and the corresponding frequency values can be obtained.

Wherein, in the step S1012, the frequency prediction signal detects the number of continuous frames of each frequency value to obtain the number of continuous frames corresponding to each frequency value. Apparently, it can also be converted into corresponding times. In some embodiments, in order to improve accuracy of the number of continuous frames corresponding to each frequency value, following steps may be adopted: performing a plurality times of detection on the number of continuous frames of each frequency value through the frequency prediction signal to obtain a plurality of numbers of continuous frames corresponding to each frequency value; and calculating an actual number of continuous frames corresponding to each frequency value according to the plurality of numbers of continuous frames. For example, it is possible to perform N times of detection, and then average the numbers of continuous frames obtained from each detection to calculate the actual number of continuous frames.

Figure 3:
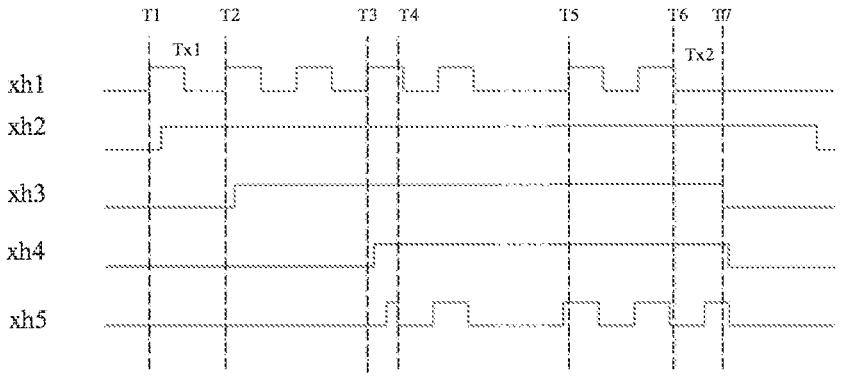
FIG. 3 is a detection timing diagram of the driving method of the display device provided by the embodiment of the present disclosure.
Figure 4:
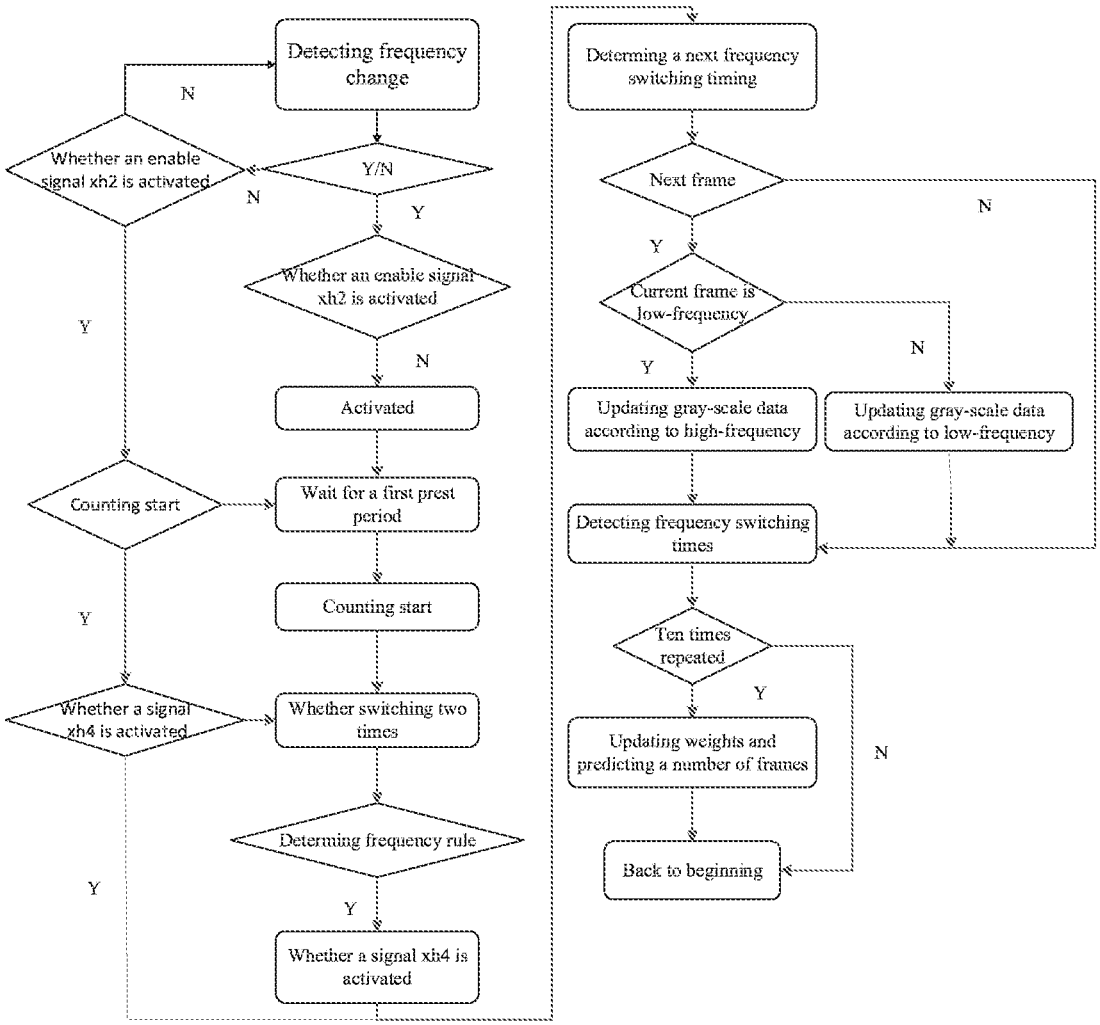
FIG. 4 is a specific schematic flowchart of the driving method of the display device provided by the embodiment of the present disclosure.

Specifically, please refer to FIGS. 3 and 4 at the same time. FIG. 3 is a detection timing diagram of the driving method of the display device provided in the embodiment of the present disclosure, and FIG. 4 is a specific schematic flowchart of the driving method of the display device provided in the embodiment of the present disclosure. As shown in FIGS. 3 and 4, a frequency detection signal xh1 is inputted, and when it is detected that the refresh frequency starts to change, a change rule detection is prepared. When the frequency detection signal xh1 lasts for a first preset time period Tx1, an enable signal xh2 of change rule detection function is pulled high, and the change rule detection starts. When it is detected that the refresh frequency changes again, an xh3 is pulled high, and after two times of switching at different frequency values are completed, the number of changed frequency values and the corresponding frequency values can be obtained. Then an xh4 is pulled high, and then a frequency prediction signal xh5 is used to detect the number of continuous frames corresponding to each frequency value. When it is detected that the predicted frames have been played (that is, within a second preset time period Tx2, and the refresh frequency is no longer switched), the detection can be stopped, and the numbers of continuous frames corresponding to a set of frequency values can be obtained.

Wherein, in the step S102, the target display frame refers to an image actually to be played when a user turns on the display device. Wherein, the current refresh frequency refers to a refresh frequency when the gray-scale compensation is started after an image starts to be played. Wherein, the frame number information refers to a frequency value corresponding to the current refresh frequency, a number of continuous frames corresponding to the frequency value, and a number of frames that have been played at a current frequency value.

Wherein, in the step S103, according to the change rule of the refresh frequency detected in the step S101, as well as the current refresh frequency and the corresponding frame number information, the expected timing for a next refresh frequency switching and the expect frequency value after switching can be calculated. For example, the current frequency value is a1, which has b frames in total. According to the change rule, it can be known that the frequency value after the frequency value a1 is a2. The current frequency value corresponds to a total of b frames, and b1 frames have already been played. Therefore, it can be calculated that there are b-b1 frames to be played to update a next refresh frequency, and then the expected timing for the next refresh frequency switching can be known.

Wherein, in the step S104, a method of querying the gray-scale compensation table may be adopted to obtain a gray-scale compensation value corresponding to each frequency value. Wherein, the gray-scale compensation table is calculated through multiple experiments in advance. Wherein, an adjustment range of the refresh frequency is 48 Hz to 240 Hz. It is possible to select several key frequency points to set binding points, that is, to test the gray-scale compensation values corresponding to the several key frequency points, and then the gray-scale compensation values corresponding to remaining frequencies can be calculated through interpolation. Wherein, if the display device is a liquid crystal display device, the gray-scale compensation can be performed by adjusting brightness of a backlight of the display device. If the display device is an organic light-emitting display device, the gray-scale compensation can be performed by adjusting a current driving method of corresponding anodes.

In some embodiments, the step S104 may comprise following sub-steps: S1041, querying the gray-scale compensation table according to the expected frequency value to obtain a corresponding gray-scale compensation value; and S1042, performing the gray-scale compensation on the display device at the expected timing according to the gray-scale compensation value. Wherein, the expected frequency value has the corresponding gray-scale compensation value in the gray-scale compensation table, which can be obtained by looking up the table. Then, at the expected timing, the gray-scale compensation value is used to perform the gray-scale compensation on the display device.

Apparently, due to errors in prediction of frequency switching timing, the above compensation method may have errors.

In some embodiments, the step S104 may comprise following sub-steps: S1043, querying the gray-scale compensation table according to the expected frequency value to obtain the corresponding gray-scale compensation value; S1044, when the next refresh frequency switching occurs, obtaining a prediction of the expected timing; S1045, obtaining a target gray-scale compensation value according to the prediction and the gray-scale compensation value; and S1046, performing the gray-scale compensation on the display device according to the target gray-scale compensation value when the refresh frequency is switched.

Wherein, in the step S1043, the expected frequency value has the corresponding gray-scale compensation value in the gray-scale compensation table, which can be obtained by looking up the table. In the step S1044, the prediction indicates whether the frequency switching timing is earlier than the expected timing or later than the expected timing, or just happens to be accurate.

In the step S1045, if the expected timing is earlier than an actual refresh frequency switching timing, and a frequency value before switching is less than the expected frequency value after switching, the gray-scale compensation value is optimized according to a first compensation coefficient X1 to obtain the target gray-scale compensation value, and X1 is greater than 1. Wherein, the target gray-scale compensation value H is X1 multiplied by the look-up table to obtain the gray-scale compensation value. Apparently, for this situation, a number of predicted frames is adjusted according to a relatively high proportion after ten times of switching, so as to update the change rule in real time, that is, to adjust the number of continuous frames corresponding to each frequency value.

If the expected timing is later than the actual refresh frequency switching timing, and the frequency value before switching is less than the frequency value after switching, the gray-scale compensation value is optimized according to a second compensation coefficient X2 to obtain the target gray-scale compensation value, and X2 is less than 1 and greater than 0. Apparently, for this situation, the number of predicted frames is adjusted according to the relatively high proportion after ten times of switching, so as to update the change rule in real time, that is, to adjust the number of continuous frames corresponding to each frequency value.

Wherein, the target gray-scale compensation value H is X2 multiplied by the look-up table to obtain the gray-scale compensation value. If the expected timing is equal to the actual refresh frequency switching timing, the gray-scale compensation value is used as the target gray-scale compensation value.

In the driving method provided by the embodiments of the present disclosure, the plurality of predicted frames are obtained, and the refresh frequency of the display device are detected based on the plurality of predicted frames to obtain the change rule of the refresh frequency; when the display device displays the target display frame, the current refresh frequency of the display device and the corresponding frame number information are obtained; the expected timing when the display device switches the refresh frequency next time and the expected frequency value after switching are predicted according to the change rule, the current refresh frequency, and the corresponding frame number information; and the gray-scale compensation is performed on the display device according to the expected frequency value and the expected timing. Therefore, the advance prediction of the frequency switching is realized, and then the advance calculation of the gray-scale compensation value is realized, which can prevent flicking caused when the refresh frequency changes.

Figure 5:
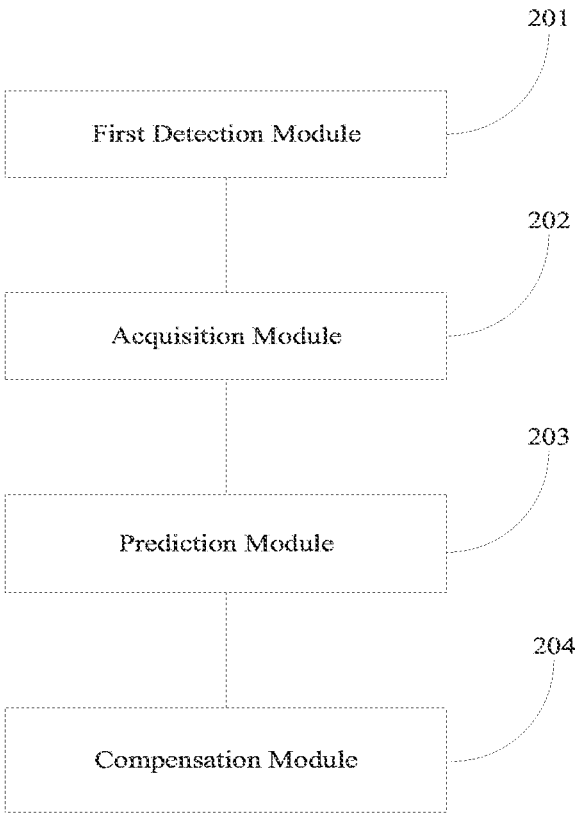
FIG. 5 is a schematic structural diagram of a display device provided by an embodiment of the present disclosure.

Please refer to FIG. 5, which is a schematic structural diagram of a display device provided by an embodiment of the present disclosure. The display device comprises: a first detection module 201, an acquisition module 202, a prediction module 203, and a compensation module 204.

Wherein, the first detection module 201 is configured to input a plurality of predicted frames, and detect a refresh frequency of the display device based on the plurality of predicted frames, so as to obtain a change rule of the refresh frequency. The plurality of predicted frames, that is, images used to detect the change rule of the refresh frequency of the display device, are pre-stored in a memory of the display device. When it is detected that the display device is powered on, the plurality of predicted frames in the memory are automatically extracted and played, so as to realize detection of the change rule of a screen refresh chip. Wherein, the change rule of the refresh frequency comprises all frequency values of the refresh frequency of the display device and a sequence thereof, a number of continuous frames or a duration time of each frequency value. For example, the frequency values are sorted by time as a1, a2, a3, a4, and a5. When it is detected that the frequency value is a2, the frequency value after next switching is a3.

Wherein, in some embodiments, the first detection module 201 is configured to: obtain the plurality of predicted frames and perform a real-time detection on the refresh frequency when the display device plays the plurality of predicted frames to obtain a plurality of frequency values of the refresh frequency; and detect the number of continuous frames of each frequency value through a frequency prediction signal to obtain the number of continuous frames corresponding to each frequency value. Wherein, it may specifically comprise: obtaining the plurality of predicted frames and playing on the display device; and after playback continues for a first preset time period, performing the real-time detection of the refresh frequency of the display device to obtain the plurality of frequency values of the refresh frequency.

Wherein, when the refresh frequency starts to change, generally speaking, the refresh frequency starts to change after a certain time period after starting to play the plurality of predicted frames. After the first preset time period, the refresh frequency gradually changes from irregular changes to regular changes and tends to be stable. Therefore, counting starts at this time to detect a number of changed frequency values and corresponding frequency values. After two times of switching are completed at different frequency values, determination can be made, and the number of the changed frequency values and the corresponding frequency values can be obtained.

Wherein, the frequency prediction signal detects the number of continuous frames of each frequency value to obtain the number of continuous frames corresponding to each frequency value. Apparently, it can also be converted into corresponding times. In some embodiments, in order to improve accuracy of the number of continuous frames corresponding to each frequency value, following steps may be adopted: performing a plurality times of detection on the number of continuous frames of each frequency value through the frequency prediction signal to obtain a plurality of numbers of continuous frames corresponding to each frequency value; and calculating an actual number of continuous frames corresponding to each frequency value according to the plurality of numbers of continuous frames. For example, it is possible to perform N times of detection, and then average the numbers of continuous frames obtained from each detection to calculate the actual number of continuous frames.

Wherein, the acquisition module 202 is configured to obtain a current refresh frequency of the display device and corresponding frame number information when the display device displays a target display frame. The target display frame refers to an image actually to be played when a user opens the display device. Wherein, the current refresh frequency refers to a refresh frequency when a gray-scale compensation is started after the image starts to be played. Wherein, the frame number information refers to a frequency value corresponding to the current refresh frequency, a number of continuous frames corresponding to the frequency value, and a number of frames that have been played at the current frequency value.

Wherein, the prediction module 203 is configured to predict an expected timing when the display device switches the refresh frequency next time and an expected frequency value after switching according to the change rule, the current refresh frequency, and the corresponding frame number information. According to the change rule of the refresh frequency detected, as well as the current refresh frequency and the corresponding frame number information, the expected timing for a next refresh frequency switching and the expect frequency value after switching can be calculated. For example, the current frequency value is a1, which has b frames in total. According to the change rule, it can be known that the frequency value after the frequency value a1 is a2. The current frequency value corresponds to a total of b frames, and b1 frames have already been played. Therefore, it can be calculated that there are b-b1 frames to be played to update a next refresh frequency, and then the expected timing of the next frequency switching can be known.

Wherein, the compensation module 204 is configured to perform the gray-scale compensation on the display device according to the expected frequency value and the expected timing. The compensation module 204 may query a gray-scale compensation table to obtain the gray-scale compensation value corresponding to each frequency value. Wherein, the gray-scale compensation table is calculated through multiple experiments in advance. Wherein, an adjustment range of the refresh frequency is 48 Hz to 240 Hz. It is possible to select several key frequency points to set binding points, that is, to test the gray-scale compensation values corresponding to the several key frequency points, and then the gray-scale compensation values corresponding to remaining frequencies can be calculated through interpolation. Wherein, if the display device is a liquid crystal display device, the gray-scale compensation can be performed by adjusting brightness of a backlight of the display device. If the display device is an organic light emitting display device, the gray-scale compensation can be performed by adjusting a current driving method of corresponding anodes.

In some embodiments, the compensation module 204 is specifically configured to: query the gray-scale compensation table according to the expected frequency value to obtain a corresponding gray-scale compensation value; and perform the gray-scale compensation on the display device at the expected timing according to the gray-scale compensation value. Wherein, the expected frequency value has the corresponding gray-scale compensation value in the gray-scale compensation table, which can be obtained by looking up the table. Then, at the expected timing, the gray-scale compensation value is used to perform the gray-scale compensation on the display device.

Apparently, due to errors in prediction of the frequency switching timing, the above compensation method may have errors.

In some embodiments, the compensation module 204 is specifically configured to: query the gray-scale compensation table according to the expected frequency value to obtain the corresponding gray-scale compensation value; when the next refresh frequency switching occurs, obtain a prediction of the expected timing; obtain a target gray-scale compensation value according to the prediction and the gray-scale compensation value; and perform the gray-scale compensation on the display device according to the target gray-scale compensation value when the refresh frequency is switched. Wherein, the expected frequency value has the corresponding gray-scale compensation value in the gray-scale compensation table, which can be obtained by looking up the table. The prediction situation indicates that whether the frequency switching timing is earlier than the expected timing or later than the expected timing, or just happens to be accurate. If the expected timing is earlier than an actual refresh frequency switching timing, and a frequency value before switching is less than the expected frequency value after switching, the gray-scale compensation value is optimized according to a first compensation coefficient X1 to obtain the target gray-scale compensation value, and X1 is greater than 1. Wherein, the target gray-scale compensation value H is X1 multiplied by the look-up table to obtain the gray-scale compensation value. Apparently, for this situation, a number of predicted frames is adjusted according to a relatively high proportion after ten times of switching, so as to update the change rule in real time, that is, to adjust the number of continuous frames corresponding to each frequency value.

If the expected timing is later than the actual refresh frequency switching timing, and the frequency value before switching is less than the frequency value after switching, the gray-scale compensation value is optimized according to a second compensation coefficient X2 to obtain the target gray-scale compensation value, and X2 is less than 1 and greater than 0. Apparently, for this situation, the number of predicted frames is adjusted according to a relatively high proportion after ten times of switching, so as to update the change rule in real time, that is, to adjust the number of continuous frames corresponding to each frequency value.

Wherein, the target gray-scale compensation value H is X2 multiplied by the look-up table to obtain the gray-scale compensation value. If the expected timing is equal to the actual refresh frequency switching timing, the gray-scale compensation value is used as the target gray-scale compensation value.

In the display device provided by the embodiment of the present disclosure, the plurality of predicted frames are inputted, and the refresh frequency of the display device are detected based on the plurality of predicted frames to obtain the change rule of the refresh frequency; when the display device displays the target display frame, the current refresh frequency of the display device and the corresponding frame number information are obtained; the expected timing when the display device switches the refresh frequency next time and the expected frequency value after switching are predicted according to the change rule, the current refresh frequency, and the corresponding frame number information; and the gray-scale compensation is performed on the display device according to the expected frequency value and the expected timing. Therefore, the advance prediction of the frequency switching is realized, and then the advance calculation of the gray-scale compensation value is realized, which can prevent flicking caused when the refresh frequency changes.

What is claimed is:

1. A method of performing gray-scale compensation of a display device, comprising:

obtaining a plurality of predicted frames pre-stored in a memory of the display device, and playing the plurality of predicted frames on the display device to perform a real-time detection on a refresh frequency of the display device to obtain a plurality of frequency values of the refresh frequency and a sequence of the frequency values;

detecting the number of continuous frames corresponding to each frequency value of the frequency values through a frequency prediction signal;

playing a target display frame on the display device to detect a current refresh frequency value of the display device and obtain a first number of frames that have been played at the current refresh frequency value;

obtaining remaining frame number corresponding to the current refresh frequency value by subtracting the first number of frames from the number of continuous frames corresponding to the current refresh frequency value;

obtaining remaining play time corresponding to the current refresh frequency value by multiplying the remaining frame number by a reciprocal of the current refresh frequency value;

obtaining an expected timing when the display device switches the refresh frequency next time by adding the remaining play time to a current timing when the display device plays the target display frame;

determining a frequency value in the sequence of the frequency values that matches the current refresh frequency value as a target frequency value, and determining a frequency value in the sequence of the frequency values immediately following the target refresh frequency value as an expected frequency value after the display device switches the refresh frequency next time;

obtaining a gray-scale compensation value corresponding to the expected frequency value by querying a gray-scale compensation table; and obtaining a prediction of the expected timing when the display device switches the refresh frequency next time by comparing an actual refresh frequency switching timing with the expected timing, obtaining a target gray-scale compensation value according to the prediction and the gray-scale compensation value, and performing the gray-scale compensation on the display device according to the target gray-scale compensation value.

2. The method according to claim 1, wherein the playing the plurality of predicted frames on the display device to perform the real-time detection on the refresh frequency of the display device comprises:

performing the real-time detection of the refresh frequency of the display device after the display device plays the plurality of predicted frames for a first preset time period.

3. The method according to claim 1, wherein the detecting the number of continuous frames corresponding to each frequency value of the frequency values through the frequency prediction signal comprises: for each frequency value of the frequency values, performing a plurality times of detection on the number of continuous frames of the frequency value through the frequency prediction signal to obtain a plurality of first numbers of continuous frames; and calculating an actual number of continuous frames corresponding to the frequency value according to the plurality of first numbers of continuous frames as the number of continuous frames corresponding to the frequency value.

4. The driving method according to claim 1, wherein the obtaining the target gray-scale compensation value according to the prediction and the gray-scale compensation value comprises:

if the expected timing is earlier than the actual refresh frequency switching timing, and a frequency value before switching is less than the expected frequency value after switching, the gray-scale compensation value is optimized according to a first compensation coefficient X1 to obtain the target gray-scale compensation value, and X1 is greater than 1; and if the expected timing is later than the actual refresh frequency switching timing, and the frequency value before switching is less than the frequency value after switching, the gray-scale compensation value is optimized according to a second compensation coefficient X2 to obtain the target gray-scale compensation value, and X2 is less than 1 and greater than 0.

5. The method according to claim 4, wherein the obtaining the target gray-scale compensation value according to the prediction and the gray-scale compensation value further comprises:

if the expected timing is equal to the actual refresh frequency switching timing, the gray-scale compensation value is used as the target gray-scale compensation value.

* * * * *